US005435403A

United States Patent [19]

Tibbitts

[11] Patent Number: 5,435,403

[45] Date of Patent: Jul. 25, 1995

[54] CUTTING ELEMENTS WITH ENHANCED STIFFNESS AND ARRANGEMENTS THEREOF ON EARTH BORING DRILL BITS

[75] Inventor: Gordon A. Tibbitts, Salt Lake City, Utah

[73] Assignee: Baker Hughes Incorporated, Houston, Tex.

[21] Appl. No.: 164,481

[22] Filed: Dec. 9, 1993

[51] Int. Cl.[6] ..... E21B 10/46

[52] U.S. Cl. ..... 175/432

[58] Field of Search ..... 175/431, 432, 434, 428

[56] References Cited

U.S. PATENT DOCUMENTS

| | | | |
|---|---|---|---|
| 4,109,737 | 8/1978 | Bovenkerk . | |
| 4,478,298 | 10/1984 | Hake et al. | 175/432 |
| 4,525,179 | 6/1985 | Gigl . | |
| 4,629,373 | 12/1986 | Hall . | |
| 4,784,023 | 11/1988 | Dennis . | |
| 4,858,707 | 8/1989 | Jones et al. . | |
| 4,872,520 | 10/1989 | Nelson . | |
| 4,954,139 | 9/1990 | Cerutti . | |
| 4,984,642 | 1/1991 | Renard et al. . | |
| 4,997,049 | 3/1991 | Tank et al. . | |
| 5,007,207 | 4/1991 | Phaal | 175/432 X |
| 5,011,515 | 4/1991 | Frushour . | |
| 5,025,874 | 6/1991 | Barr et al. . | |
| 5,037,451 | 8/1991 | Burnand et al. . | |
| 5,054,246 | 10/1991 | Phaal et al. . | |
| 5,120,327 | 6/1992 | Dennis . | |
| 5,172,778 | 12/1992 | Tibbits et al. . | |
| 5,217,081 | 6/1993 | Waldenstrom et al. . | |
| 5,301,762 | 4/1994 | Besson | 175/432 X |

FOREIGN PATENT DOCUMENTS

| | | | |
|---|---|---|---|
| 0322214B | 6/1992 | European Pat. Off. . | |
| 2212190 | 7/1989 | United Kingdom | 175/432 |

OTHER PUBLICATIONS

Republic of South Africa Provisional Specification entitled "Composite Abrasive Compact" for De Beers Industrial Diamond Division Limited, Dec. 23, 1992.

*Primary Examiner*—William P. Neuder

*Attorney, Agent, or Firm*—Trask, Britt & Rossa

[57] ABSTRACT

A cutting element having a substantially planar table of superhard material mounted on a substrate or backing. The superhard material table, the substrate, or an insert placed between those two components provides additional stiffness to the cutting element and resistance to bending and impact loading experienced by the cutting element when drilling a formation. The additional stiffness reduces fracture of the table of superhard material and, if the reinforcing member or portion is formed of an abrasion and erosion resistant material, the cutting element will wear linearly at a reduced rate due to the enhanced volume of such material. The thicker or reinforced portion of the cutting element extends linearly, and if the cutting element is circular, extends diametrically. Cooperative arrangements of such cutting elements are also disclosed.

23 Claims, 5 Drawing Sheets

CUTTING ELEMENTS WITH ENHANCED STIFFNESS AND ARRANGEMENTS THEREOF ON EARTH BORING DRILL BITS

BACKGROUND OF THE INVENTION

1. Field of the Invention

The present invention relates generally to superhard cutting elements, and more specifically to substantially planar polycrystalline diamond compact cutting elements comprising a polycrystalline diamond table formed and bonded to a supporting substrate or backing during formation of the cutting element.

2. State of the Art

Polycrystalline diamond compact cutting elements, commonly known as PDC's, have been commercially available for over 20 years. PDC's may be self-supporting or may comprise a substantially planar diamond table bonded during formation to a supporting substrate. A diamond table/substrate cutting element structure is formed by stacking into a cell layers of fine diamond crystals (100 microns or less) and metal catalyst powder, alternating with wafer-like metal substrates of cemented tungsten carbide or other suitable materials. In some cases, the catalyst material may be incorporated in the substrate in addition to or in lieu of using a powder catalyst intermixed with the diamond crystals. A loaded receptacle is subsequently placed in an ultra-high temperature (typically 1450°–1600° C.) ultrahigh pressure (typically 50–70 kilobar) diamond press, wherein the diamond crystals, stimulated by the catalytic effect of the metal power, bond to each other and to the substrate material. The spaces in the diamond table between the diamond to diamond bonds are filled with residual metal catalysis. A so-called thermally stable PDC product (commonly termed as TSP) made be formed by leaching out the metal in the diamond table. Alternatively, silicon, which possesses a coefficient of thermal expansion similar to that of diamond, may be used to bond diamond particles to produce a Si-bonded TSP. TSP's are capable of enduring higher temperatures (on the order of 1200° C.) without degradation in comparison to normal PDC's, which experience thermal degradation upon exposure to temperatures of about 750°–800° C.

While PDC and TSP cutting elements employed in rotary drag bits for earth boring have achieved major advances in obtainable rate of penetration while drilling and in greatly expanding the types of formations suitable for drilling with diamond bits at economically viable cost, the diamond table/substrate configurations of state of the art planar cutting elements leave something to be desired.

First, bending attributable to the loading of the cutting element by the formation may cause fracture or even delamination of the diamond table from the substrate. It is believed that such degradation of the cutting element is due at least in part to lack of sufficient stiffness of the cutting element so that, when encountering the formation, the diamond table actually flexes due to lack of sufficient rigidity or stiffness. As diamond has an extremely low strain rate to failure, only a small amount of flex can initiate fracture.

In addition to the aforementioned shortcoming, state of the art PDC's often lack sufficient diamond volume to cut highly abrasive formations, as the thickness of the diamond table in state of the art cutting elements is not adequate for such formations.

Furthermore, the use of single-thickness diamond tables on cutting elements travelling in overlapping or partially overlapping circular paths may result in unnecessary redundancy of diamond volume in the overlap area.

The benefits of a multi-thickness diamond table, which produces a kerfing action during drilling as the thicker portions wear less than the thinner portions, have been recognized. Kerfing may generally be defined as grooving, scoring or scribing a formation, and more specifically as relieving a formation, ideally in a ratio of at least one to one in groove height to width. However, all such prior art PDC configurations (see, for example, U.S. Pat. Nos. 4,784,023 and 5,120,327) employ parallel linear interleaved ridges of diamond and substrate extending across the cutting element. However, the use of several parallel thick ridges on the relatively small surface of a typical PDC cutting element may fail to provide any kerfing benefit whatsoever in terms of energy expended to drill in harder or more abrasive formations.

Another PDC cutting element structure which affords a multiple-depth diamond table is disclosed in European Patent Specification Publication No. 0 322 214 B1. This structure's substrate ridges resemble a "bulls-eye" pattern in one embodiment, and a spiral pattern in another. While allegedly providing curved cutting ridges as the cutting element wears, wear of such ridges causes the primary contact points between the cutting element and the formation to migrate rapidly laterally, so that a deep kerf or cleft in the formation at a substantially constant radial location at the bottom of the borehole is never effected.

Yet another PDC cutting element structure which affords a multiple-depth diamond table is disclosed in U.S. Pat. No. 4,984,642. In this instance, the ridges or grooves are actually formed in the surface of the diamond table rather than at the boundary between the diamond table and the underlying, supporting substrate. However, this structure possess the same deficiencies as the previously-referenced patents employing interleaved ridges of diamond and substrate extending across the substrate element.

U.S. patent application Ser. No. 08/016,085, filed Feb. 10, 1993 and assigned to the assignee of the present invention, discloses the use of a substrate with radially-oriented lands to redistribute stresses at the diamond-/substrate interface, which structure also provides a multiple-depth diamond table.

Still another PDC cutting element structure which affords a diamond table having either an increased or reduced thickness in the center of the cutting element is disclosed in U.S. Pat. No. 4,954,139. In this instance, while the diamond table may indeed be thicker as it approaches the center of the cutting element, the periphery or skirt of the diamond table which initially encounters the formation is of reduced thickness, and thus inherently less stiff and more flexible.

SUMMARY OF THE INVENTION

In contrast to the prior art, the cutting element of the present invention comprises a substantially planar structure of circular, rectangular or other suitable cross-section comprising a PDC, TSP, or other superhard material table bonded to a supporting substrate, the superhard table possessing a linearly-extending portion of enhanced thickness. Such a configuration provides additional stiffness for the cutting structure, and also beneficially increases compressive stresses in the superhard material table and lowers tensile stresses in the substrate.

In some embodiments of the invention, the area of increased thickness extends inwardly toward the substrate, leaving a substantially planar cutting face on the cutting element, while in other embodiments the thicker portion of the superhard table actually protrudes from the primary, planar portion of the cutting face.

It is also contemplated as part of the present invention that the cutting elements of the present invention may be arranged in particular cooperative patterns on the face of the drill bit, so that the primary area of contact between each cutting element and the formation is in the aforementioned thickened portion of each cutting element. In such an arrangement, cutting elements are located on adjacent radii on the face of drill bit, cutting adjacent circular paths as the drill bit is rotated, which paths overlap to an extent that the thicker portion of each cutting element carries the brunt of formation loading on that cutter. Thus, a thicker portion of a cutting element superhard table cuts a kerf or trough in the borehole bottom which is immediately laterally adjacent or even overlapping with that cut by the thicker portion of the superhard table of a first cutting element. In such a manner, those portions of each cutting element which are designed to best sustain loading and impact during the cutting operation are the portions of each cutting element primarily exposed to the formation, while other portions of the superhard table and cutting face of each cutting element which do not sustain large loads and perform the primary cutting function may be of lesser thickness. As a result, the diamond or other superhard material of the cutting element table may be concentrated to provide the requisite stiffness against loading by the formation, and the grouping of such cutting elements to cut laterally adjacent or overlapping circular paths in the borehole bottom promotes effective kerfing of the formation while permitting the cutting element to be manufactured at a reasonable cost due to the reduced thickness of the superhard table in the portions of the cutting face flanking the linearly extending increased thickness portion. Stated another way, diamond volume redundancy in lower-wear areas of the overlapping cutting elements may be substantially reduced without degrading cutting element performance.

In one embodiment, the cutting element of the present invention comprises a supporting substrate carrying a table of superhard material having a linearly extending integral reinforcing portion of such material. In the case of circular cutting element, the linearly extending, thicker portion of the superhard material table may be a diametrically extending portion or bar.

Yet another embodiment of the present invention contemplates the use of a substrate or backing for the superhard material table designed to offer increased resistance to impact in bending in combination with a superhard material table which possesses the aforementioned linearly extending area of enhanced thickness.

Still another embodiment of the present invention contemplates the use of an insert placed between the superhard material table and the substrate or backing to provide a reinforcing and stiffening function in the cutting element.

DETAILED DESCRIPTION OF THE PREFERRED EMBODIMENTS

Figure 1:
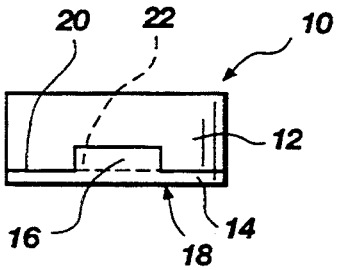
FIGS. 1–9 of the drawings comprise top elevations of a selection of alternative geometries for a first preferred embodiment of the present invention.
Figure 2:
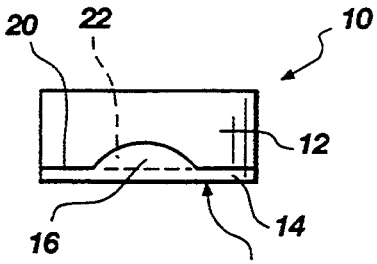
Figure 3:
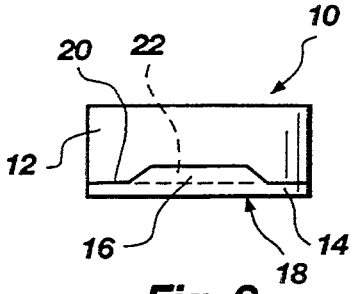
Figure 4:
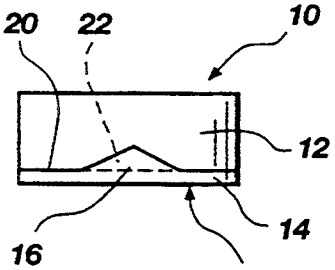
Figure 5:
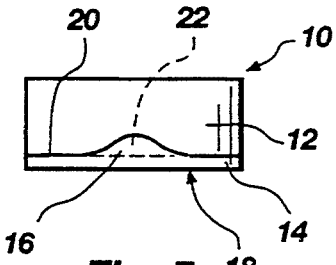
Figure 6:
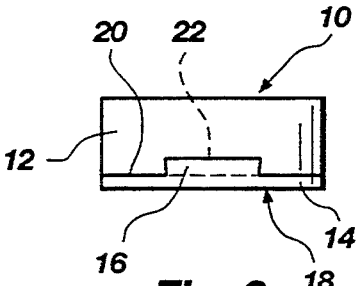
Figure 7:
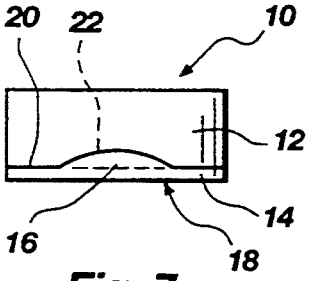

Referring now to FIGS. 1–9 of the drawings, a plurality of cutting elements 10 of alternative geometries are depicted as viewed from above as the cutting elements 10 would be mounted on the face of drill bit. Each cutting element 10 comprises a substrate or backing 12 having secured thereto a substantially planar table 14 of a superhard material such as a polycrystalline diamond compact (PDC), a thermally stable product (TSP), a cubic boron nitride compact (CBN), a diamond film either deposited (as by chemical vapor or plasma deposition, for example) directly on the substrate 12 or on one of the other aforementioned superhard materials, or any other superhard material known in the art.

Figure 8:
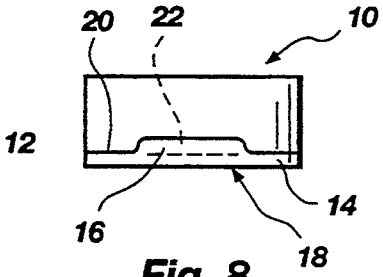
Figure 9:
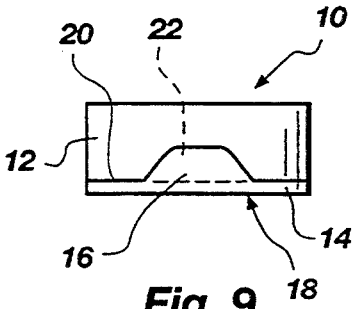

Superhard tables 14 comprise two portions, a first center portion 16 of enhanced thickness as measured from the cutting face 18 of the cutting element towards substrate 12, and peripheral flank or skirt portions 20 of relatively lesser thickness flanking the center portion 16 on both sides. The substrate 12 may be sintered tungsten carbide or other material or combination of materials as known in the art, and the cutting elements 10 may be fabricated employing the technique previously described in the background of the invention and state of the art, or any other suitable process known in the art. A most preferred embodiment of the cutting element 10 of the present invention is shown in FIG. 8, with portion 16 having radiused edges.

As depicted in FIGS. 1–9, center portions 16 (also termed reinforcing portions) of superhard material tables 14 are of substantially regular shape and extend linearly across the cutting face 18 of cutting elements 10. If cutting element 10 is a circular cutting element, center portion 16 would normally extend diametrically across the surface of the cutting element 10.

A major feature of the linearly extending center portion 16 is that the center portion 16 may be oriented when mounted on the bit so as to be substantially perpendicular to the profile of the bit face. With such an orientation, as the cutting element 10 wears, the wear will be primarily sustained through center portion 16 so as to maximize the use of the additional material in the thicker portion of the superhard material table. Further, as the cutting element 10 of the present invention is designed to be stiffer than the prior state of the art cutting element, the thicker portion 16 of the superhard material table 14 should be properly oriented with respect to the impact and bending forces sustained by the cutting element as its cutting face 18 engages the formation, so that the thicker or "reinforced" portion 16 performs as a column or a bar in resisting the bending loads applied at the outermost edge of the cutting element at the point of engagement with the formation. Finally, the presence of portion 16 increases the compressive stresses in the superhard material table 14 and lowers the tensile stresses in substrate 12.

Figure 10:
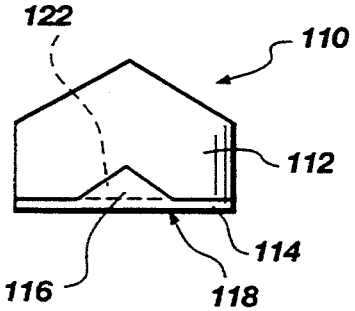
FIGS. 10–15 comprise top elevations of a variety of alternative geometries for a second preferred embodiment of the superhard cutting element of the present invention.
Figure 11:
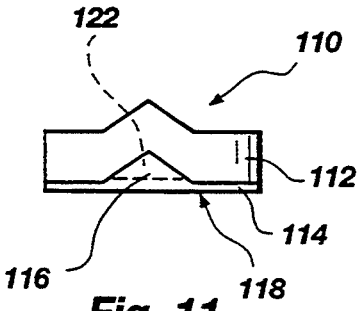
Figure 12:
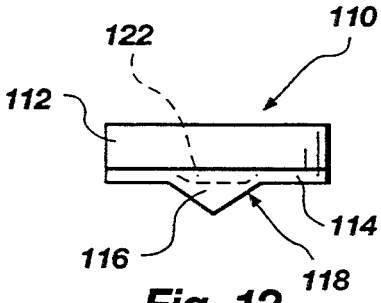
Figure 13:
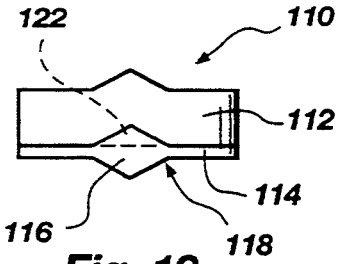
Figure 14:
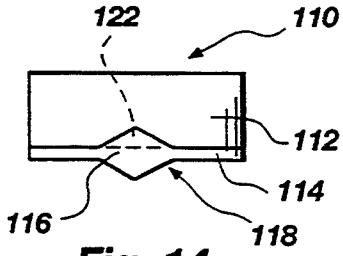
Figure 15:
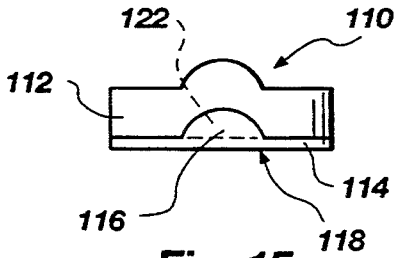

FIGS. 10–15 comprise a variety of alternative geometries suitable for use in a second preferred embodiment 110 of the cutting element of the present invention. Cutting elements 110, as depicted, employ a substrate or backing 112, a superhard material table 114, and a table portion 116 of enhanced thickness, which are designed to cooperatively provide a higher stiffness and greater resistance to impact and bending of the cutting element, as well as increased volume of superhard material without unnecessary redundancy. The beneficial pre-stressing of the superhard table and stress reduction in the substrate previously described are also realized. As shown in FIGS. 10, 11 and 15, the cutting face 118 of cutting element 110 may be absolutely planar, or, as shown in FIGS. 12, 13 and 14, a portion of the cutting face 118 may protrude from the major portion thereof in the area of the thicker, reinforced portion 116 of the superhard material table 114.

It is also contemplated that the diamond or other superhard material tables 14 and 114 of the first and second preferred embodiments of the cutting elements of the present invention may, in fact, be of substantially uniform thickness across the cutting face. In such an instance, the additional thickness or reinforcement provided by portions 16 and 116 of the cutting elements 10 and 110, respectively, may comprise a segment or insert 22 or 122 of another material having high stiffness and resistance to bending, for example another superhard material, or tungsten or cobalt-tungsten alloy. In such an embodiment of the invention as with those previously described, the segment or insert 22 or 122 introduces a compressive pre-stress in the diamond or other superhard material table 14, 114 to provide additional strength and thereby reduce the incidence of fracture of the superhard material table during the drilling operation. It is desirable that the insert 22, 122 be located at the interface between the substrate 12, 112 and the superhard material table 14, 114 and have a surface which is parallel to and substantially coincident with the interface between the substrate and the superhard table. The insert may extend substantially into the depth of the substrate, and even to the rear surface thereof farthest away from the superhard material table. The insert at the interface between the substrate and the superhard material table should, for effectiveness, comprise an area and thickness designed to substantially increase the compressive stresses within the superhard material table and substantially decrease the tensile stress in the substrate. As noted previously with respect to the use of an integral reinforcing portion 16 or 116 extending across the cutting face 18 or 118, it is preferable that any insert 22, 122 employed be of linear and regular shape, and extend across the face of the cutting element. For the insert to be effective, it is desirable that it be of a material that is different than that of the substrate and of greater coefficient of thermal expansion so that, upon cooling of the cutting element after fabrication, there is produced in the interior of the cutting element a compressive pre-stress which strengthens the superhard material table. 0f course, as previously noted, the insert 22, 122 would also typically be of substantial stiffness or resistance to bending in order to provide structural reinforcement to the cutting element against bending stress. Stated another way, the insert should provide an enhanced strain energy capacity to the cutting element. While tungsten carbide is previously been noted as a suitable substrate material, it is also contemplated that other cemented carbides may be employed. If the substrate is a carbide substrate, the insert 22, 122 might then be formed of a similar carbide having diamond or other superhard material particles dispersed therein for enhanced abrasion or erosion resistance during the cutting operation, or it might be made of a superhard material which is the same or different than that of the planar superhard table defining the cutting face of the cutting element. Alternatively, the insert 22, 122 might be made of a cemented carbide of a different metal than that employed in the substrate, or might be made of a same metal of the substrate, however, employing a larger grain size or a higher metal binder content. During fabrication of the cutting element of the present invention in a form wherein an insert is employed, a carbide substrate or so called "green" or unsintered precursor thereof is formed with an appropriately shaped groove or channel in the surface upon which the superhard material is to be located. The insert material may then be placed in the groove or channel, and may comprise either loose material or a pre-formed insert. Thereafter, the particles of superhard material which will be formed into the table are placed over the substrate, and the assembly subjected to the aforementioned elevated temperatures and pressures to produce a superhard compact. Alternatively, the superhard table may be deposited on the substrate by plasma or chemical vapor deposition as a film.

Figure 16:
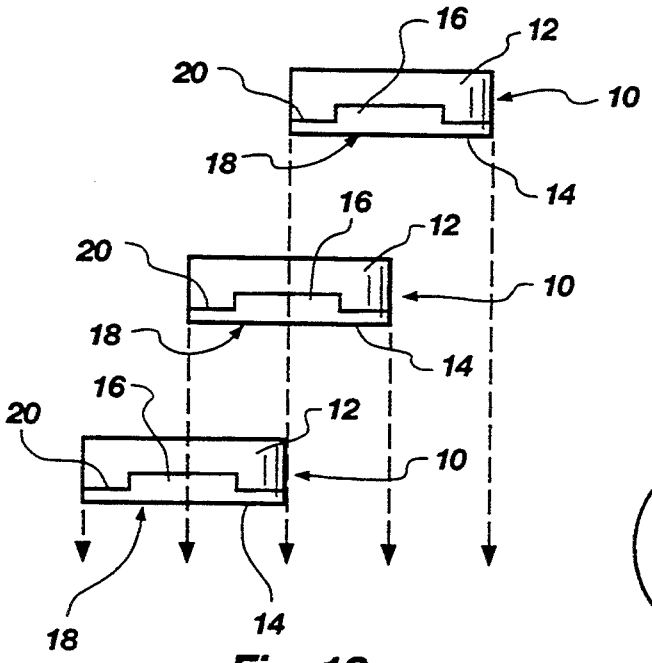
FIG. 16 comprises a top elevation of three superhard cutting elements according to the present invention mounting in partial overlapping relationship on the face of a drill bit.

Referring now to FIG. 16 of the drawings, there is depicted a plurality of cutting elements 10 according to the first preferred embodiment of the present invention as seen from a top elevation as these cutting elements would be mounted on the face and insert of a drill bit. As may be easily seen, cutting elements 10 are partially laterally overlapped so that the thicker or reinforcing portions 16 of each superhard material table 14 (moving as shown in the direction of the arrows) cut a substantially laterally adjacent and even somewhat contiguous kerf or trough in the formation being drilled as the drag bit of which the cutting elements 10 are mounted rotates at the bottom of the borehole. While the cutting elements 10 have been shown moving linearly for purposes of simplicity, it will be understood by those skilled in the art that the cutting paths are actually adjacent arcs.

It will be appreciated that the reinforced sections 16 of superhard material tables 14 cutting elements 10 sustain a majority of the impact and bending loads and, because they are each oriented perpendicular to the profile of the bit face at the location of each cutting element, the wear of the cutting element will proceed down through the reinforced portions 16 which have the maximum resistance to abrasion and erosion, causing the cutting elements 10 to last far longer than current state of the art cutting elements. The skirt or flank portions 20 of the cutting elements 10 are of sufficient thickness to resist wear caused by formation debris and the drilling fluid used in the cutting operation, but may be of substantially reduced thickness in comparison to the reinforced portion 16 due to the fact that they do not take the primary cutting function.

Figure 17:
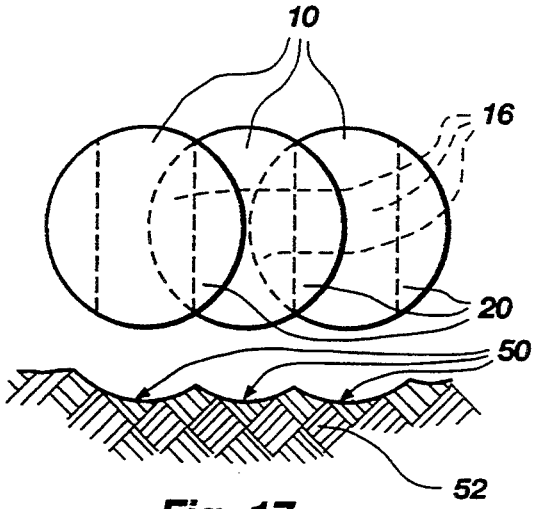
FIG. 17 comprises a front elevation of circular cutting elements located as depicted in FIG. 16.

FIG. 17 depicts cutting elements as arranged in FIG. 16 in a frontal elevation, shown placed above the kerfs or troughs 50 cut in formation 52 by each of the cutting elements as the rotary drag bit rotates at the bottom of the borehole. The lateral boundaries of center portions 16 of each superhard material table 10 are depicted in broken lines, so that is will be appreciated how the lateral overlap of cutting elements 10 causes the inner portion 16 to present, in effect, a segmented cutting structure of greatly increased thickness extending across the drill bit.

Figure 18:
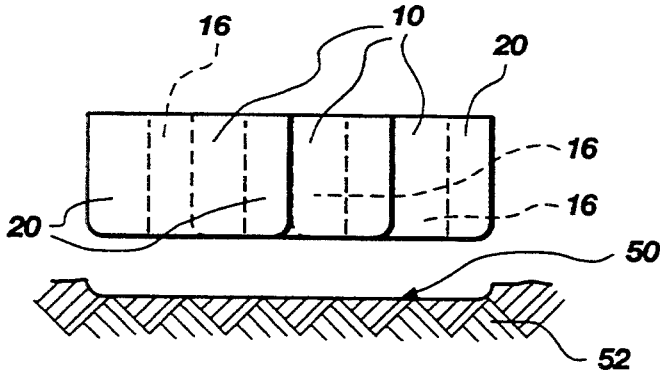
FIG. 18 comprises a plurality of square or rectangular cutting elements located as depicted in FIGS. 16.

FIG. 18 depicts rectangular or square shaped cutting elements 10 in the overlapping relationship depicted in FIG. 16.

Figure 19:
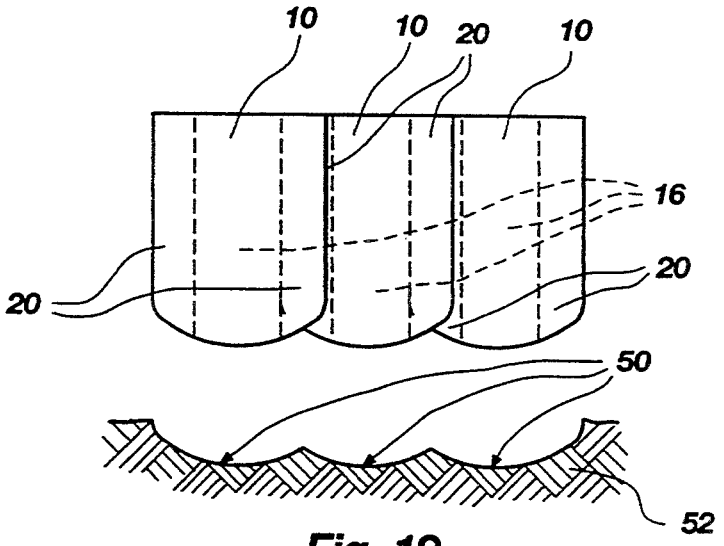
FIG. 19 comprises a plurality of "tombstone" shaped cutting elements located substantially as depicted in FIG. 16, but having greater relative lateral spacing.
Figure 20A:
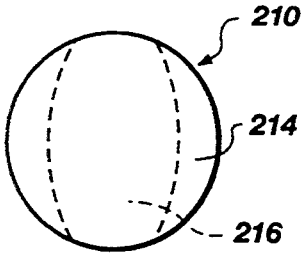
FIGS. 20A–22A comprise front elevations of a variety of alternative geometries for a third preferred embodiment of the superhard cutting element of the present invention and FIGS. 20B–22B comprise top elevations corresponding to the front elevations.

FIG. 19 depicts an arrangement of tombstone shaped cutting elements 10 which is similar to the arrangements of FIGS. 17 and 18, but the cutting elements 10 of FIG. 19 have been laterally positioned so that the thicker or reinforced portions 16 are, in fact, laterally separated as the cutting elements 10 are viewed head-on looking into the cutting faces 18. Such an arrangement provides better or wider coverage for a given number of cutting elements, and may reduce the number of cutters required on the face of the drill bit. Such an arrangement is equally as effective as the arrangements depicted in FIG. 16, 17 and 18 in providing additional stiffness to the cutting elements and resistance to bending and impact loading on the cutting face. In many formations, such an expanded lateral army of cutting elements 10 will be quite sufficient to cut the formation, as the flank or skirt portions 20 of the cutting elements are of sufficient thickness due to their lateral overlap. However, in highly abrasive formations, it is preferred that the lateral dispersion of the cutting elements 10 not extend beyond the point where the lateral boundaries of the reinforced portion 16 of the cutting elements 10 are coincident or closely mutually adjacent.

Figure 21A:
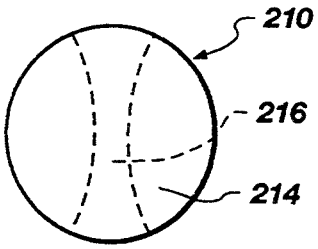
Figure 22A:
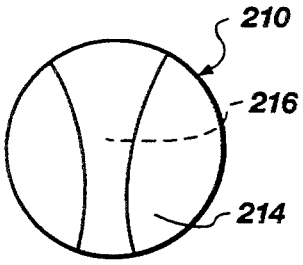
Figure 20B:
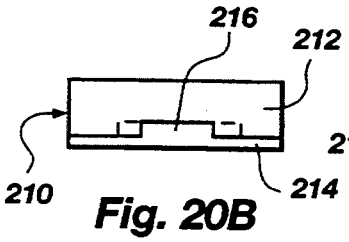
Figure 21B:
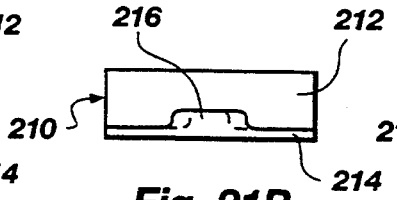
Figure 22B:
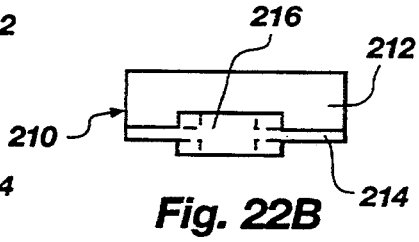
Figure 23A:
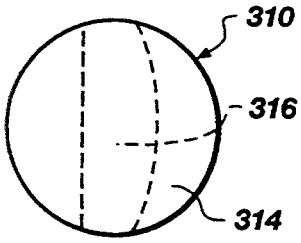
FIGS. 23A–25A comprise front elevations of a variety of alternative geometries for a fourth preferred embodiment of the superhard cutting element of the present invention and FIGS. 23B–25B comprise top elevations corresponding to the front elevations.
Figure 24A:
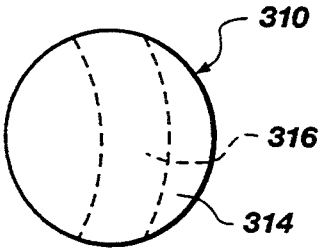
Figure 25A:
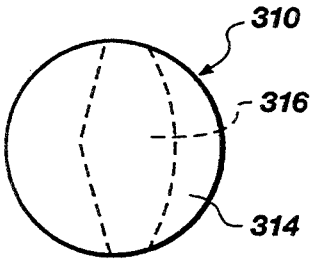
Figure 23B:
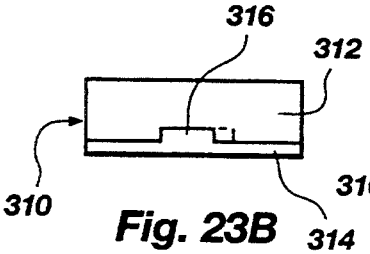
Figure 24B:
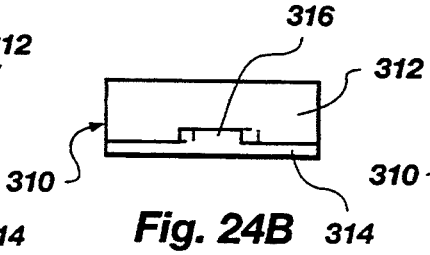
Figure 25B:
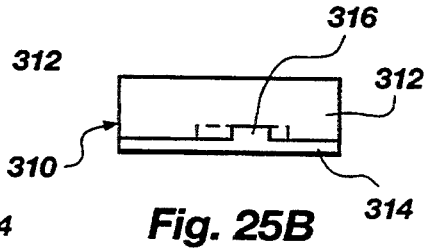
Figure 26:
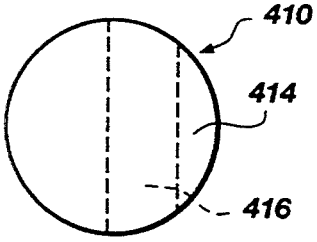
FIGS. 26–28 comprise front elevations of a variety of alternative geometries for a fifth preferred embodiment of the superhard cutting element of the present invention.
Figure 27:
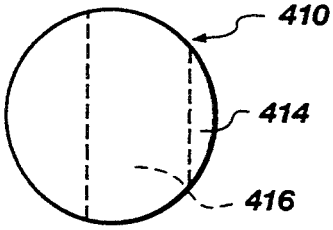
Figure 28:
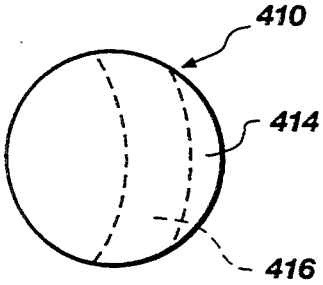

FIGS. 20A, 20B, 21A, 21B, 22A and 22B depict cutting elements 210 including substrates 212, superhard material tables 214 and reinforcing portions 216 comprising inserts or integral portions of the superhard material tables. Portions 216 have non-linear lateral boundaries. FIGS. 21A and 21B also depict radiused edges on portion 216, which radii may be the same or different at different edges. FIGS. 22A and 22B also depict portion 216 protruding from the plane of table 214. FIGS. 223A, 23B, 24A, 24B, 25A and 25B depict cutting elements 310 including substrates 312, superhard material tables 314 and reinforcing portions 316 comprising inserts or integral portions of the superhard material table. Portions 316 have nonsymmetrical lateral boundaries and which are somewhat nonsynmetrically located. FIGS. 26–28 depict cutting elements 410 including substrates 412, superhard material tables 414 and portions 416 which are substantially nonsymmetrically located. All of the foregoing embodiments of the cutting element of the present invention are contemplated to provide the benefits previously described with respect to the other embodiments. In addition, use of nonlinear lateral boundaries, nonsymmetrical lateral boundaries and/or nonsymmetrical placement of portions 16, 116, 216, 316 and 416 of the cutting elements of the present invention enable the cutting element designer to locate and direct compressive stresses in the superhard material tables to maximum benefit, and to reduce the tensile stresses in the substrates to a minimum, as well as to orient such stresses in a manner beneficial to the placement of any particular cutting element on the bit profile. For example, cutting elements placed near or at the gage of the bit are subjected to substantial directional loading, termed high lateral "pinching" loads. Off-setting reinforcing portions 16, 116, 216, 316 or 416 from the cutting element diameter in an asymmetrical manner can preferentially pre-stress the diamond table in a particular direction and thus cause a cutting element to better accommodate such lateral loads, which may substantially exceed normal force loads (in the direction of the bit axis) at the gage.

Figure 29:
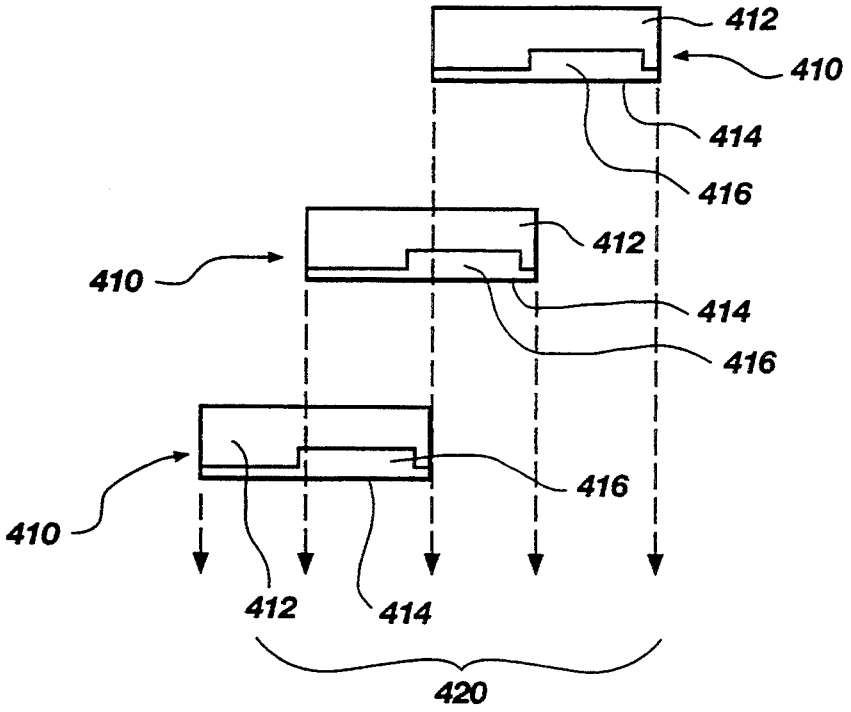
FIG. 29 comprises a top elevation of three superhard cutting elements according to the fifth preferred embodiment of the present arrangement mounted in partial overlapping relationship on the face of a drill bit.

Referring to FIG. 29, cutting elements 410 are depicted from a top elevation in partial overlapping relationship so that the portions 416 travel in adjacent paths as depicted in FIG. 16 with respect to the cutting elements 10. With the arrangement of FIG. 29, however, more volume of superhard material is located toward one side 420 of a cutting element arrangement, which arrangement is highly beneficial at the gage of the bit where loads are high and cutting element speed and travel are greatest.

Figure 30:
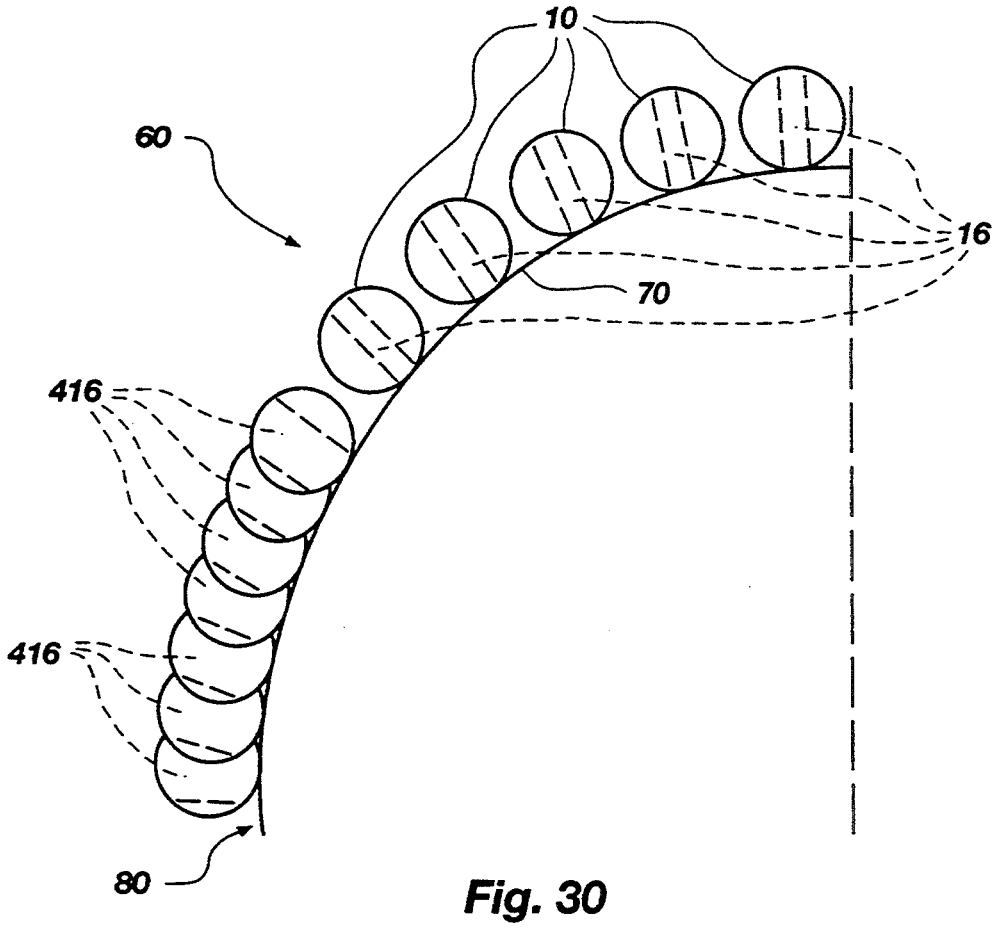
FIG. 30 is a schematic depiction of cutting elements according to the present invention mounted on the profile of a drill bit.

Referring now to FIG. 30, cutting elements 10 of the present invention are depicted with portions 16 oriented substantially perpendicular to the profile 70 of bit 60, so as to achieve maximum resistance to bending for each cutting element 10. Cutting elements 410 are also depicted in an arrangement near and at the gage 80 of the bit 60, showing how the concentration of superhard material volume provided by cooperating offset portions 416 can accommodate the lateral loading of the cuffing elements at the gage.

Figure 31:
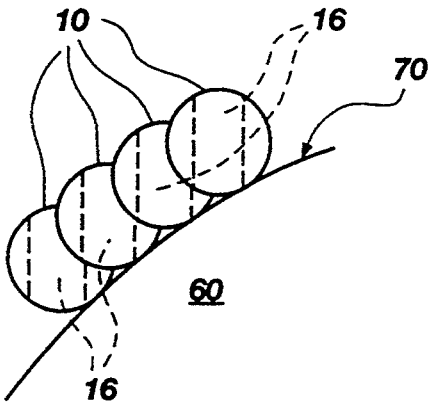
FIG. 31 is another schematic depiction of cutting elements according to the present invention mounted on the profile of a drill bit.

Referring now to FIG. 31 of the drawings, cutting elements 10 are shown with thicker, superhard material table portions 16 in mutually parallel relationship, but in non-perpendicular relationship to bit profile 70 of bit 60. With the orientation shown in FIG. 31, both the overlap of the cutting elements and the non-perpendicular (to the profile) relative orientations of thicker portions 16 can be utilized to achieve concentration of superhard material volume in high wear areas, and may also be used to orient portions 16 to better sustain high loads from particular directions.

Figure 32A:
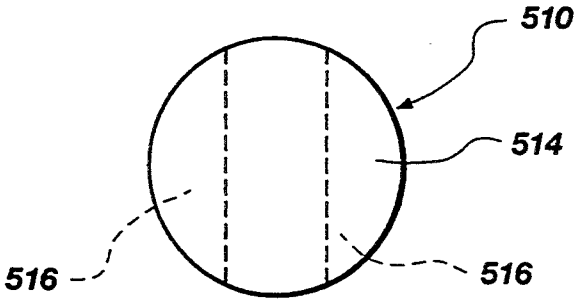
FIGS. 32A and 32B comprise a front elevation and top elevation, respectively, of an alternate embodiment of the cutting element of the present invention.
Figure 32B:
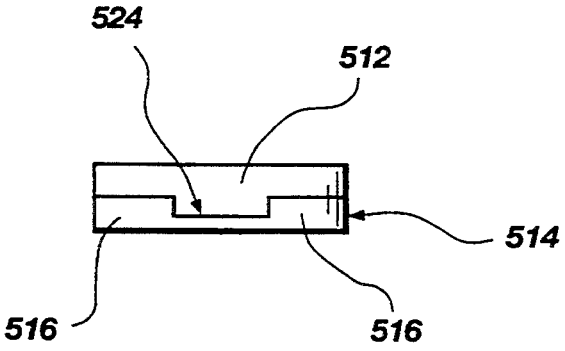

While the previously-illustrated embodiments of the invention have only depicted a single reinforcing or thicker portion, with larger cutting elements 510 comprising a substrate 512 and table 514, it may be desirable to employ multiple substantially parallel portions 516 as depicted in FIGS. 32A and 32B flanking a center table area 524 of reduced thickness. Such cutting elements 510 may be arranged in groups as previously illustrated with respect to other embodiments of the invention to avoid superhard material redundancy and/or to concentrate superhard material volume when desired. Of course, on extremely large cutters, three or perhaps even more thicker portions 16 (such as on a blade-type cutter) may be employed.

While the present invention has been described in terms of certain preferred embodiments and variations in geometry therein, it will be appreciated by one of ordinary skill in the art that the invention is not so limited. Many additions, deletions, and modifications to the illustrated embodiment may be made without departing from the scope of the present invention as defined in the following claims.

What is claimed is:

1. A cutting element for a rotary drag bit for drilling subterranean formations, comprising:

a substrate;

a substantially planar table of superhard material supported by said substrate; and stiffening means integral with said cutting element for providing enhanced resistance to bending of said cutting element.

2. The cutting element of claim 1, wherein said stiffening means is located proximate the interface between said table and said substrate.

3. The cutting element of claim 1, wherein said stiffening means is integral with said table.

4. The cutting element of claim 3, wherein said stiffening means comprises a substantially continuous table portion of increased thickness extending transversely on said cutting element.

5. The cutting element of claim 4, wherein said transversely-extending table portion is of regular cross-sectional configuration.

6. The cutting element of claim 4, wherein said transversely-extending table portion extends completely across said table.

7. The cutting element of claim 6, wherein said cutting element has a circular cutting face, and said transversely-extending table portion extends diametrically.

8. The cutting element of claim 6, wherein said transversely-extending table portion is laterally flanked by skirt portions of said table of relatively lesser thickness.

9. The cutting element of claim 2, wherein said stiffening means is of different material composition than said substrate or said table.

10. The cutting element of claim 9, wherein said stiffening means comprises a preformed insert.

11. A cutting element arrangement on a rotary drag bit for drilling a subterranean formation, said bit having a longitudinal axis and a bit face defining a profile, and comprising:

a first cutting element including a substrate supporting a substantially planar table of superhard material and transversely-extending stiffening means for providing enhanced resistance to bending of said first cutting element; and a second cutting element including a substrate supporting a substantially planar table of superhard material and transversely-extending stiffening means for providing enhanced resistance to bending of said second cutting element;

each of said first and said second cutting elements being disposed on said bit face on adjacent radii from the center of said bit face with each of said tables oriented at an acute angle to a radius intersecting that cutting element.

12. The cutting element arrangement of claim 11, wherein said stiffening means comprise integral table portions of increased thickness.

13. The cutting element arrangement of claim 11, wherein said tables are placed in overlapping radial locations so that said stiffening means of said cutting elements travel in immediately adjacent arcuate paths upon rotation of said bit.

14. The cutting element arrangement of claim 11, wherein said tables are placed in overlapping radial locations so that said stiffening means of said cutting elements travel in partially overlapping arcuate paths upon rotation of said bit.

15. The cutting element arrangement of claim 11, wherein said cutting elements are circular and said stiffening means extend diametrically.

16. The cutting element arrangement of claim 11, wherein said cutting elements are non-circular and each of said stiffening means is laterally flanked on either side thereof by a portion of said superhard material table.

17. The cutting element arrangement of claim 11, wherein said transversely-extending stiffening means are oriented in substantially perpendicular relationship to said profile.

18. The cutting element arrangement of claim 11, wherein said stiffening means extend substantially continuously in a transverse direction.

19. A rotary drill bit, comprising:

a bit body having a face defining a profile; and at least one cutting element mounted on said bit face, said at least one cutting element including a substrate supporting a substantially planar table of superhard material, and transversely-extending stiffening means for providing enhanced resistance to bending of said at least one cutting element.

20. The drill bit of claim 18, wherein said stiffening means is oriented substantially perpendicular to said profile.

21. The drill bit of claim 18, wherein said stiffening means is located proximate the interface between said table and said substrate.

22. The drill bit of claim 18, wherein said stiffening means is integral with said table.

23. The drill bit of claim 18, wherein said stiffening means extends substantially continuously in a transverse direction.

* * * * *

UNITED STATES PATENT AND TRADEMARK OFFICE

CERTIFICATE OF CORRECTION

PATENT NO. : 5,435,403

DATED : July 25, 1995

INVENTOR(S) : Gordon A. Tibbitts

It is certified that error appears in the above-indentified patent and that said Letters Patent is hereby corrected as shown below:

In Column 1, line 36, change "catalysis" to --catalyst--;

In Column 1, line 37, change "made" to --may--;

In Column 2, line 42, change "possess" to --possesses--;

In Column 3, line 19, after "of" insert --the--;

In Column 4, line 53, after "of" insert --a--;

In Column 7, line 14, after "14" insert --of--;

In Column 7, line 34, change "10" to --14--;

In Column 7, line 35, change "is" to --it--;

In Column 7, line 54, change "FIG." to --FIGS.--;

In Column 8, line 7, change "223A" to --23A--;

In Column 8, line 12, after "boundaries" delete "and"; and

In Column 8, line 59, change "cuffing" to --cutting--.

Signed and Sealed this

Sixth Day of August, 1996

*Attest:*

*Attesting Officer*

Bruce Lehman

BRUCE LEHMAN

*Commissioner of Patents and Trademarks*